US010684002B2

(12) United States Patent
Isayama

(10) Patent No.: US 10,684,002 B2
(45) Date of Patent: Jun. 16, 2020

(54) LIFTING/LOWERING DEVICE

(71) Applicant: ISA CO., LTD., Yokohama-shi, Kanagawa (JP)

(72) Inventor: Kiyoshi Isayama, Yokohama (JP)

(73) Assignee: ISA CO., LTD., Yokohama-shi (JP)

( * ) Notice: Subject to any disclaimer, the term of this patent is extended or adjusted under 35 U.S.C. 154(b) by 0 days.

(21) Appl. No.: 16/609,275

(22) PCT Filed: Jul. 6, 2018

(86) PCT No.: PCT/JP2018/025761

§ 371 (c)(1),
(2) Date: Oct. 29, 2019

(87) PCT Pub. No.: WO2019/009418

PCT Pub. Date: Jan. 10, 2019

(65) Prior Publication Data

US 2020/0049335 A1 Feb. 13, 2020

(30) Foreign Application Priority Data

Jul. 7, 2017 (JP) ..... 2017-134052

(51) Int. Cl.
*F21V 21/38* (2006.01)
*F21V 21/16* (2006.01)
(Continued)

(52) U.S. Cl.
CPC ..... *F21V 21/38* (2013.01); *F21V 21/16* (2013.01); *F21V 23/003* (2013.01); *F21V 23/04* (2013.01);
(Continued)

(58) Field of Classification Search
CPC ..... F21V 21/38; F21V 21/16
(Continued)

(56) References Cited

U.S. PATENT DOCUMENTS 2,348,987 A * 5/1944 Lock ..... B66D 1/38 242/157.1
4,087,060 A * 5/1978 Laky ..... B65H 54/2803 242/399.1
(Continued)

FOREIGN PATENT DOCUMENTS

JP H07-272526 A 10/1995
JP 2004-207031 A 7/2004
(Continued)

OTHER PUBLICATIONS

Sep. 25, 2018 Search Report issued in International Patent Application No. PCT/JP2018/025761.

*Primary Examiner* — Bryon T Gyllstrom
(74) *Attorney, Agent, or Firm* — Oliff PLC

(57) ABSTRACT

An elevation apparatus is provided that initializes a calculated travel distance of a to-be-lifted object. The elevation apparatus includes a housing that has a side wall in a longitudinal direction and that has an opening in a lower face, a reel rotating to wind a reel wire, the reel wire wound on the reel to elevate the to-be-lifted object attached to a tip end of the reel wire and the to-be-lifted object is suspended from the lower side of the elevation apparatus, a controller for calculating a travel distance along which the to-be-lifted object is elevated, and a reset switch provided in the housing. The to-be-lifted object is lifted to depress the reset switch. The depression of the reset switch allows the controller to initialize the calculated travel distance.

6 Claims, 16 Drawing Sheets

(51) Int. Cl.
*F21V 23/00* (2015.01)
*F21V 23/04* (2006.01)
*F21W 131/105* (2006.01)
*F21W 131/406* (2006.01)

(52) U.S. Cl.
CPC . *F21W 2131/105* (2013.01); *F21W 2131/406* (2013.01)

(58) Field of Classification Search
USPC ..... 362/282
See application file for complete search history.

(56) References Cited

U.S. PATENT DOCUMENTS 6,435,447 B1 * 8/2002 Coats ..... E21B 19/22 242/483
10,093,522 B1 * 10/2018 Baugh ..... B66D 1/36
2005/0087644 A1 * 4/2005 Kim ..... B65H 75/425 242/390.8
2008/0217460 A1 * 9/2008 Shin ..... B66D 3/08 242/390.1
2008/0247179 A1 10/2008 Isayama
2011/0193037 A1 * 8/2011 Smith ..... B66D 3/18 254/336
2013/0187105 A1 * 7/2013 Xydias ..... B66D 1/30 254/277
2014/0084229 A1 * 3/2014 Morrison ..... B66D 1/00 254/344
2014/0145129 A1 5/2014 Bauder
2019/0078765 A1 * 3/2019 Isayama ..... F21S 8/061

FOREIGN PATENT DOCUMENTS

JP 2006-089238 A 4/2006
JP 2006-210164 A 8/2006
JP 2006-302686 A 11/2006
JP 2009-533300 A 9/2009
JP 5173231 B2 4/2013

* cited by examiner

LIFTING/LOWERING DEVICE

TECHNICAL FIELD

The present disclosure relates to an elevation apparatus. In particular, the present disclosure relates to an elevation apparatus to initialize the travel distance of a to-be-lifted object calculated when the to-be-lifted object is elevated.

BACKGROUND ART

Stage illumination apparatuses are used in stage representation to support the performance of a product by expressers for a theatrical performance or dance for example. As disclosed in Patent Literature, an illumination apparatus exists that controls the elevation and light of lighting elements to provide stage representation. This illumination apparatus has an illumination elevation apparatus that elevates the lighting elements by winding and unwinding the reel wire connected to the lighting elements. A three-dimensional representation is provided by changing, over time, the length of the reel wire connecting the illumination elevation apparatus to the lighting elements and the light from the lighting elements by controlling software.

CITATION LIST

Patent Literature

[Patent Literature 1] Japanese Patent No. 5173231

SUMMARY

In the case of the above-described three-dimensional representation, the elevating operation of a plurality of lighting elements (to-be-lifted objects) is controlled by a plurality of illumination elevation apparatuses, respectively. This control is performed based on a predefined representing procedure, thus substantially requiring the knowledge of the travel distance of the to-be-lifted object (lifting/lowering height). In order to determine such a travel distance, a rotary encoder (hereinafter "encoder") may be provided that operates in cooperation with a motor to wind the reel wire. The encoder rotates in cooperation with the motor to output a two-phase pulse signal. Thus, the rotation amount of the encoder can be calculated by adding the rising timing of the pulse signal etc. received by the control circuit. The encoder rotates in cooperation with the rotation of the motor and thus can determine the travel distance of the to-be-lifted object.

The encoder includes a light emitting element and a light receiving element. Light from the light emitting element is received by the light receiving element (by passing through slits provided at an equal interval). The light receiving element also may detect not only light but also noise. Furthermore, the reel may be idle due to the reel wire insufficiently wound on the reel. The above-described cases may have an influence on the calculation of the rotation amount by the encoder, which may cause an error between the travel distance of the to-be-lifted object calculated by the control circuit and the actual travel distance of the to-be-lifted object.

The stage representation may be continued for a long time. Thus, a plurality of minor errors may lead to a major error. This may be a causing factor of the failure of a desired elevating control in the stage representation. In order to reduce the error effects, it is desirable to initialize, at a fixed timing, the calculated travel distance of the to-be-lifted object.

Another approach is to issue, at a fixed timing, an initialization instruction to the control circuit to initialize the travel distance of the to-be-lifted object. This initialization instruction must be issued while the to-be-lifted object is at an initial position (height) (e.g., while the reel wire is completely wound and the to-be-lifted object is completely lifted). However, it is not possible to recognize the accurate position of the to-be-lifted object in the state where the error occurs. Thus, it is difficult to issue the initialization instruction in such state while the to-be-lifted object being at the initial position.

According to the embodiment, an elevation apparatus is provided that initializes, at a fixed timing, the travel distance of the to-be-lifted object calculated when to-be-lifted object is lifted/lowered.

An elevation apparatus according to one embodiment s an elevation apparatus provided in a longitudinal direction set in a vertical direction. The elevation apparatus includes: a housing that has a side wall in a longitudinal direction and that has an opening in a lower face; a reel rotating to wind a reel wire, the reel wire is wound on the reel to elevate a to-be-lifted object attached to a tip end of the reel wire and the to-be-lifted object is suspended from the lower side of the elevation apparatus, a controller for calculating a travel distance by which the to-be-lifted object is elevated; and a reset switch provided in the housing. The to-be-lifted object is lifted to depress the reset switch. The depression of the reset switch allows the controller to initialize the calculated travel distance.

The structure of the elevation apparatus according to one embodiment can provide the initialization of the travel distance calculated while allowing the to-be-lifted object to be at an accurate position.

DESCRIPTION OF EMBODIMENTS

With reference to the attached drawings, the following section will describe an elevation apparatus according to one embodiment. The elevation apparatus according to one embodiment is provided in an apparatus providing a stage representation (stage representation apparatus), and suspended from a ceiling for example in a longitudinal direction set in a vertical direction. The elevation apparatus is used to elevate a to-be-lifted object. The terms "upper", "upper part", "upper end", and "upper face" herein mean an upper side, an upper part, an upper end, and an upper face of the elevation apparatus suspended in the longitudinal direction set in the vertical direction with regard to the ground as a reference, respectively. The terms "lower", "lower part", "lower end", and "lower face" mean a lower side, a lower part, a lower end, and a lower face of the elevation apparatus suspended in the longitudinal direction set in the vertical direction with regard to the ground as a reference, respectively.

When the elevation apparatus is used in the stage representation, it is often that a more number of lighting elements are suspended from a suspension baton or a ceiling in order to provide a more gorgeous stage representation (i.e., a plurality of elevation apparatuses are suspended from the suspension baton or the ceiling). Under such background, many elevation apparatuses suspended from the suspension baton or the ceiling cause an extremely-high load on the suspension baton or the ceiling. An increase of the weight of the elevation apparatuses causes a higher risk where an elevation apparatus accidentally falls off during the stage representation. In light of this risk, the elevation apparatus desirably has a more simple structure and a less light weight. The elevation apparatus according to one embodiment solves the above-described disadvantage by employing a simple structure.

First Embodiment

Figure 1:
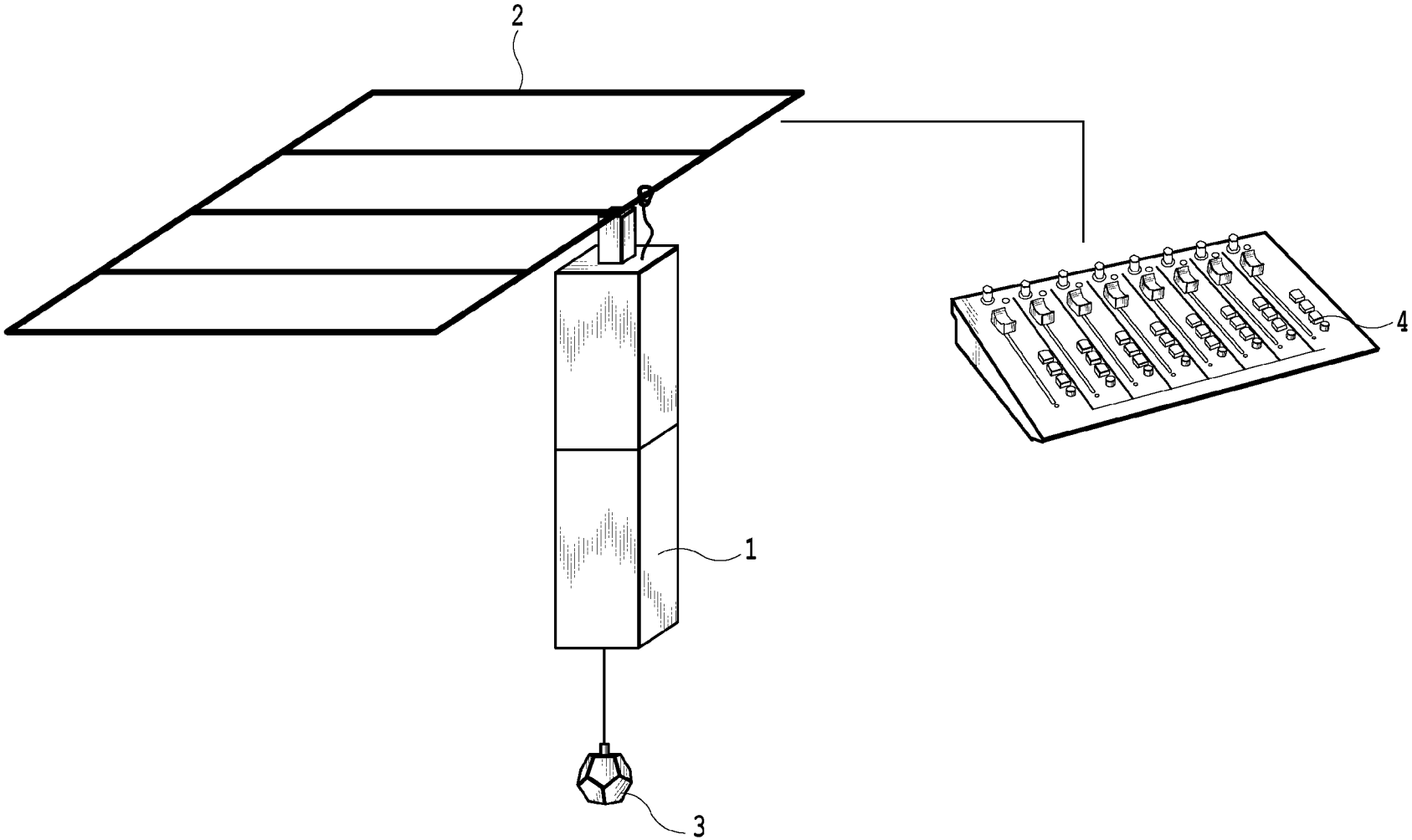
FIG. 1 illustrates the configuration of a stage representation apparatus according to the first embodiment.

FIG. 1 illustrates the structure of a stage representation apparatus according to the first embodiment that includes an elevation apparatus 1, a suspension baton 2, a lighting element 3, and a controller 4. The elevation apparatus 1 is suspended from the suspension baton 2 by an upper end of the elevation apparatus 1 connected to the suspension baton 2. As shown in FIG. 1, the elevation apparatus 1 is suspended in the longitudinal direction set in the vertical direction. The elevation apparatus 1 elevates the lighting element 3 by rotating the reel through driving an electric motor provided therein to wind and unwind on the reel the reel wire attached to the lighting element 3. The elevation of the lighting element 3 is controlled by by executing a program on the controller 4 connected to the elevation apparatus 1.

The suspension baton 2 is a stage mechanism that has a receptacle box including a power receptacle for connecting a tool. The suspension baton 2 is provided at the stage ceiling, and suspends the elevation apparatus 1. The suspension baton 2 according to this embodiment well-known in the relevant art, and thus will not be described in detail. The elevation apparatus 1 also may be suspended from the ceiling for example instead of the suspension baton 2.

The lighting element 3 is a light source that emits light with light intensity depending on an instruction from the controller 4. The lighting element 3 is connected to the reel wire and is suspended downwardly from the lower side of the elevation apparatus 1. The lighting element 3 has an arbitrary shape and uses a halogen light or an LED (Light-Emitting Diode) for example. The lighting element 3 desirably has a less light weight in consideration of the burden on the suspension baton 2. The lighting element 3 according to this embodiment is also well-known in the relevant art and thus will not be described in detail.

The controller 4 is a device including a control circuit including (such as CPU (Central Processing Unit) or an FPGA (Field Programmable Gate Array)) and executes, depending on a stage representation procedure, a program stored therein. The controller 4 sends control signal(s) to one or more of the elevation apparatus(s) 1 to control the respective elevating operations. Similarly, the controller 4 sends control signal(s) to one or more of the lighting element(s) 3 to control the respective light intensities. The controller 4 also includes a counter that adds a predetermined number at a falling (or rising) timing of a pulse signal from a detection unit 14 (which will be described later).

Figure 2:
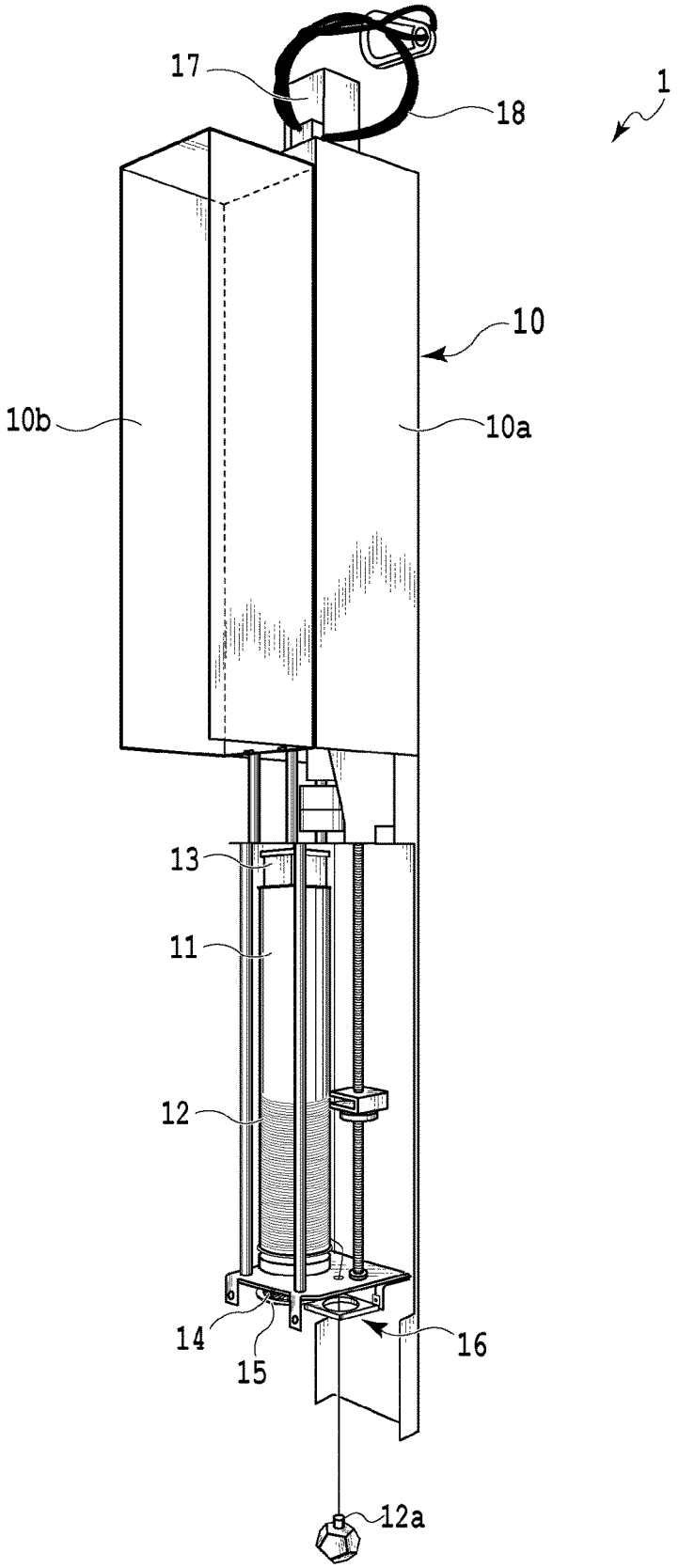
FIG. 2 illustrates the configuration of an elevation apparatus according to the first embodiment.

Next, with reference to FIG. 2, the following section will describe the structure of the elevation apparatus 1 according to the first embodiment. The elevation apparatus 1 includes a housing 10, a reel 11, a reel wire 12, an electric motor 13, the detection unit 14, an anti-misdetection member 15, a reset switch 16, an attaching part 17, and an attaching hook 18.

Figure 3A:
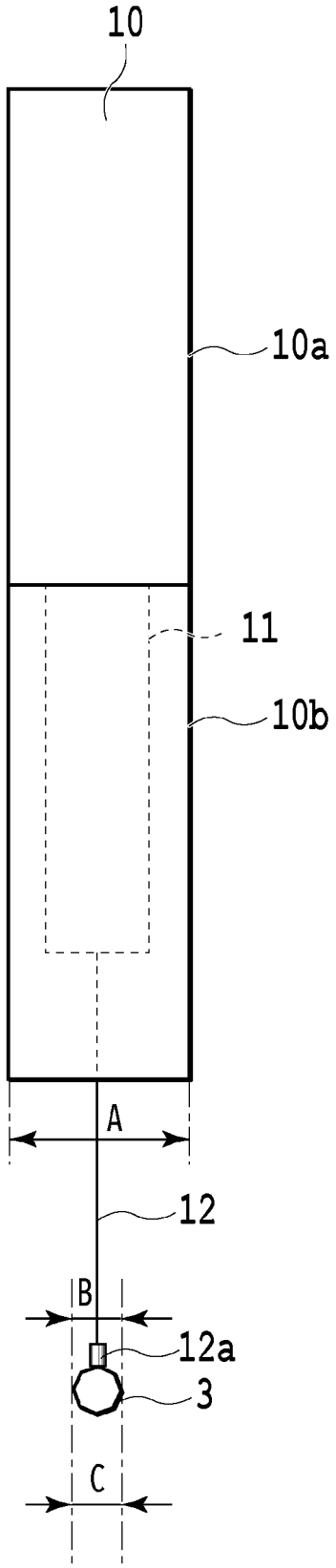
FIG. 3A illustrates the relation between a housing and a lighting element according to the first embodiment.
Figure 3B:
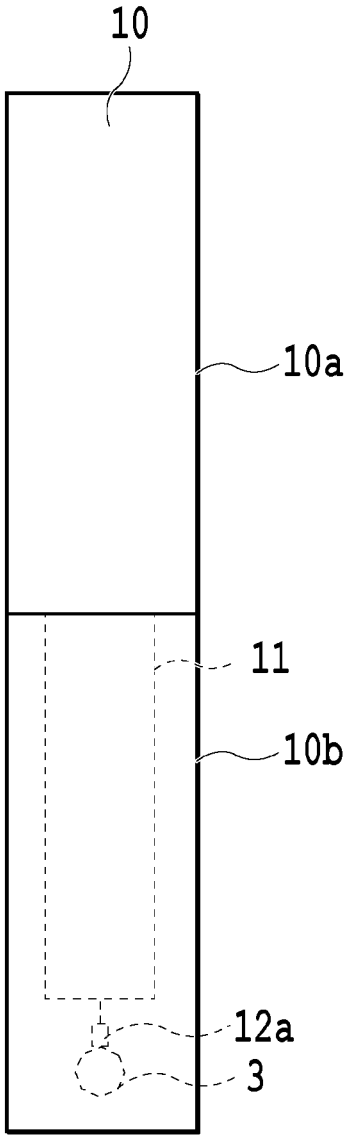
FIG. 3B illustrates the relation between the housing and the lighting element according to the first embodiment.

The housing 10 includes an upper housing 10*a* and a lower housing 10*b* both of which have a rectangular parallelepiped. The entirety of the housing 10 has a hollow structure to accommodate a component such as the reel 11. The lower housing 10*b* has a lower face including an opening (i.e., the lower face of the elevation apparatus 1). As shown in FIG. 3A, the opening provided in the lower face of the housing 10 has an area A that is larger than an area B of the upper face of the lighting element 3 and an area C of the lower face of the lighting element 3. The structure as described above allows, as shown in FIG. 3B, the lighting element 3 while being lifted to enter the housing 10 through the opening.

The upper housing 10*a* is fixed. The lower housing 10*b* has a structure that can be opened or closed. The elevation apparatus 1 shown in FIG. 1 is in a state where the lower housing 10*b* is closed to cover the respective components such as the reel 11. A stage representation is provided while the lower housing 10*b* being closed. The elevation apparatus 1 shown in FIG. 2 shows an upper body in which the lower housing 10*b* is opened and the respective components such as the reel 11 are exposed. This opening/closing structure can provide an easy maintenance work of the respective components provided in the elevation apparatus 1. The housing 10 desirably includes light-weight material such as plastic or resin.

The reel 11 has a cylindrical shape and is provided so that the longitudinal direction thereof is parallel to the longitudinal direction of the housing 10. The reel 11 is connected to the electric motor 13 and rotates around an axis in the short end direction by the drive of the electric motor 13. The rotation of the reel 11 in one direction provides a single winding of the reel wire 12 and the rotation of the reel 11 in opposite direction provides the unwinding of the reel wire 12. The reel 11 desirably includes light-weight material such as aluminium. The reel 11 is not limited to the cylindrical shape and also may have any regular polygon such as a rectangular shape when viewed in a longitudinal direction and a square, triangle, pentagon, or hexagon shape for example when viewed in a short end direction.

The reel wire 12 has a connector 12*a* at a tip end thereof and is attached to the lighting element 3 via the connector 12*a*. The reel wire 12 is protruded in the lower direction from the lower part of the elevation apparatus 1. Specifically, the lighting element 3 attached to the tip end of the reel wire 12 is suspended downwardly from the lower side of the elevation apparatus 1.

The electric motor 13 includes a rotation axis rotating based on a control signal from the controller 4 (e.g., by turning to "High" the state of a motor drive signal outputted to the electric motor 13). The electric motor 13 operates in cooperation with the detection unit 14 that detects the rotation amount of the electric motor 13 (the reel 11). In this embodiment, the detection unit 14 is implemented in an encoder rotating according to the rotation of the rotation axis of the electric motor 13 (the reel 11). The detection unit 14 includes a light emitting element, a lens, a cord wheel, and a light receiving element (not shown). The cord wheel has a plurality of slits provided at an equal interval and rotates according to the rotation of the rotation axis of the electric motor 13. Light from the light emitting element is collected by the lens and the light is received by the light receiving element through the slits of the cord wheel. Then, the resultant light is processed by a signal conversion circuit unit (not shown), thereby finally outputting, to the controller 4, two pulse signals of a pulse signal A (A phase) and a pulse signal B (B phase). The following section will describe, with reference to FIG. 4, the pulse signal A phase and the pulse signal B phase.

Figure 4:
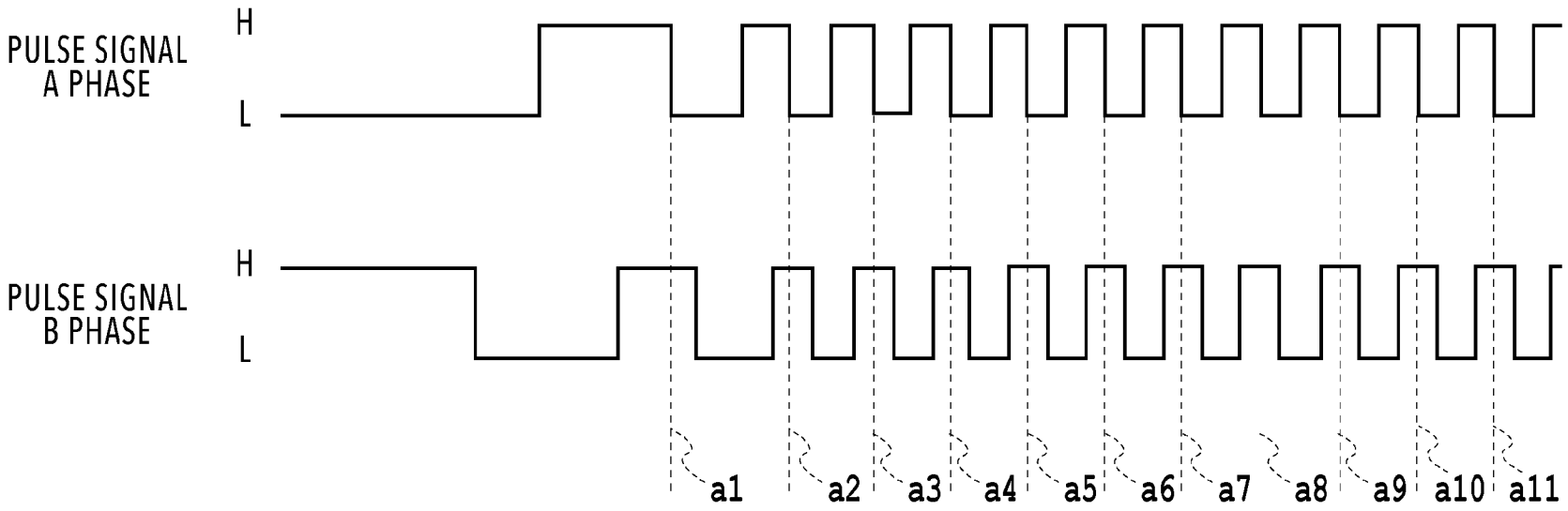
FIG. 4 illustrates a waveform of a pulse signal outputted from a detection unit according to the first embodiment.

As shown in FIG. 4, during the rotation of the electric motor 13, a cycle is repeated in which any of the pulse signal A phase and the pulse signal B phase is changed from a High state to a Low state (or from the Low state to the High state). For example, when the reel wire 12 is wound (i.e. the lighting element 3 is lifted), then the pulse signal B phase is in the High state and the pulse signal A phase is changed from the High state to the Low state, and this cycle for the pulse signal to fall is repeated (the timings from al to all shown in FIG. 4). When the reel wire 12 is unwound (i.e. when the lighting element 3 is lowered), then the signal state is changed in an opposite manner, and this cycle for the pulse signal to rise is repeated. This state change of the pulse signal represents that the reel 11 rotates by a predetermined rotation amount. Thus, the counter of the controller 4 can add a predetermined number at the above-described timing at which the pulse signal falls to calculate the travel distance of each lighting element 3 of the elevation apparatus 1.

In this embodiment, the controller 4 calculates the travel distance of the lighting element 3 based on a pulse signal outputted from the detection unit 14. However, the embodiment is not limited to such a configuration. The elevation apparatus 1 also may include a control circuit (counter) having a computation function so that the counter adds a predetermined number at the above-described falling timing of a pulse signal to calculate the travel distance to send the calculated travel distance to the controller 4. The initialization instruction and the motor control described below will be described as executed by the controller 4. However, the above control also may be executed by the above-described control circuit of the elevation apparatus 1.

The detection unit 14 may be a contact-type or noncontact-type encoder for detecting the travel distance of the lighting element 3. In this embodiment, the detection unit 14 is implemented in an incremental-type two-phase output method in which two pulse waves have a phase difference of 90 degrees. However, the embodiment is not limited to such a configuration. The detection unit 14 may implemented in an incremental-type three-phase output method in which a Z phase of 1 rotation and 1 pulse as an origin signal are added to a two-phase pulse wave. Alternatively, the detection unit 14 may implemented in an absolute-type method in which the respective rotation positions of the slits may be formed to have a unique code pattern and many light receiving elements can be used to directly extract the respective unique signal.

Figure 5A:
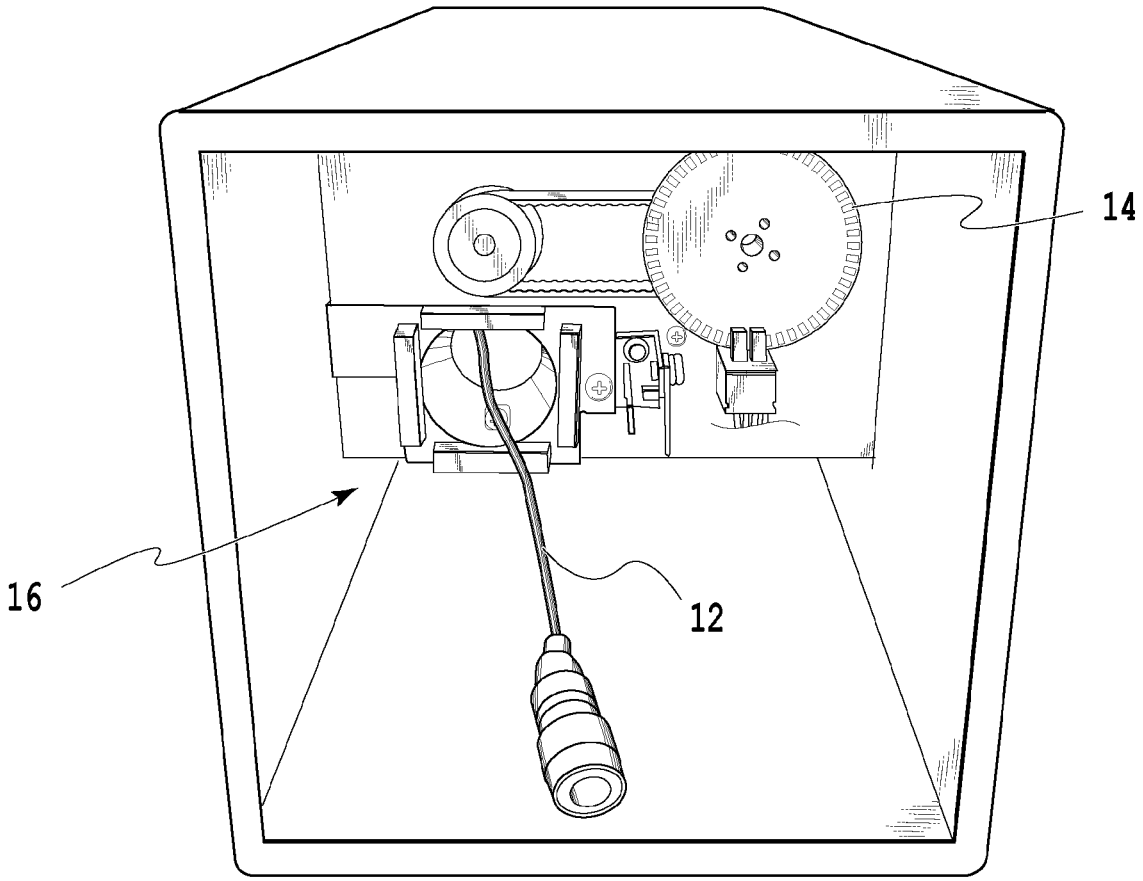
FIG. 5A illustrates the configuration of the detection unit and an anti-misdetection member according to the first embodiment.
Figure 5B:
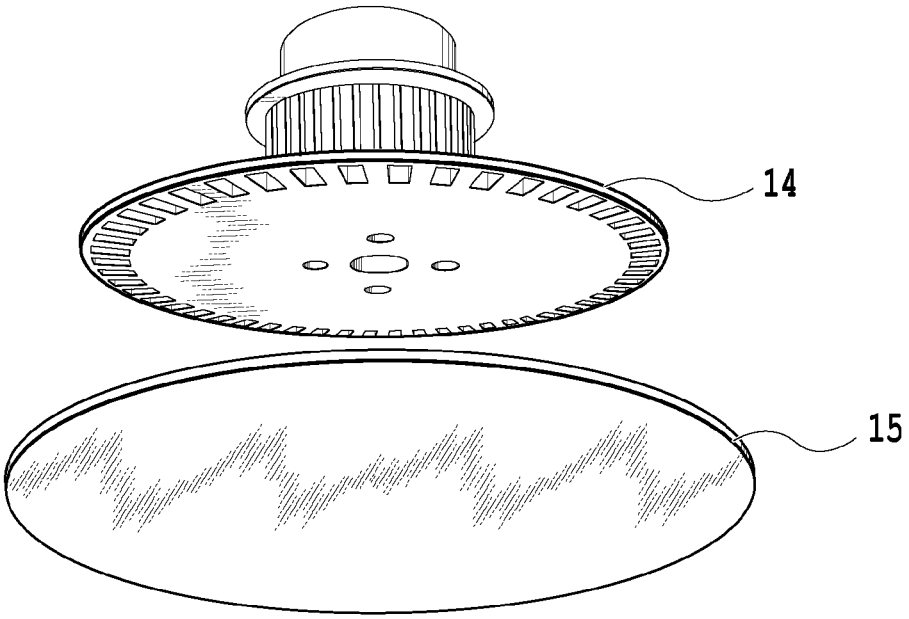
FIG. 5B illustrates the configuration of the detection unit and the anti-misdetection member according to the first embodiment.
Figure 5C:
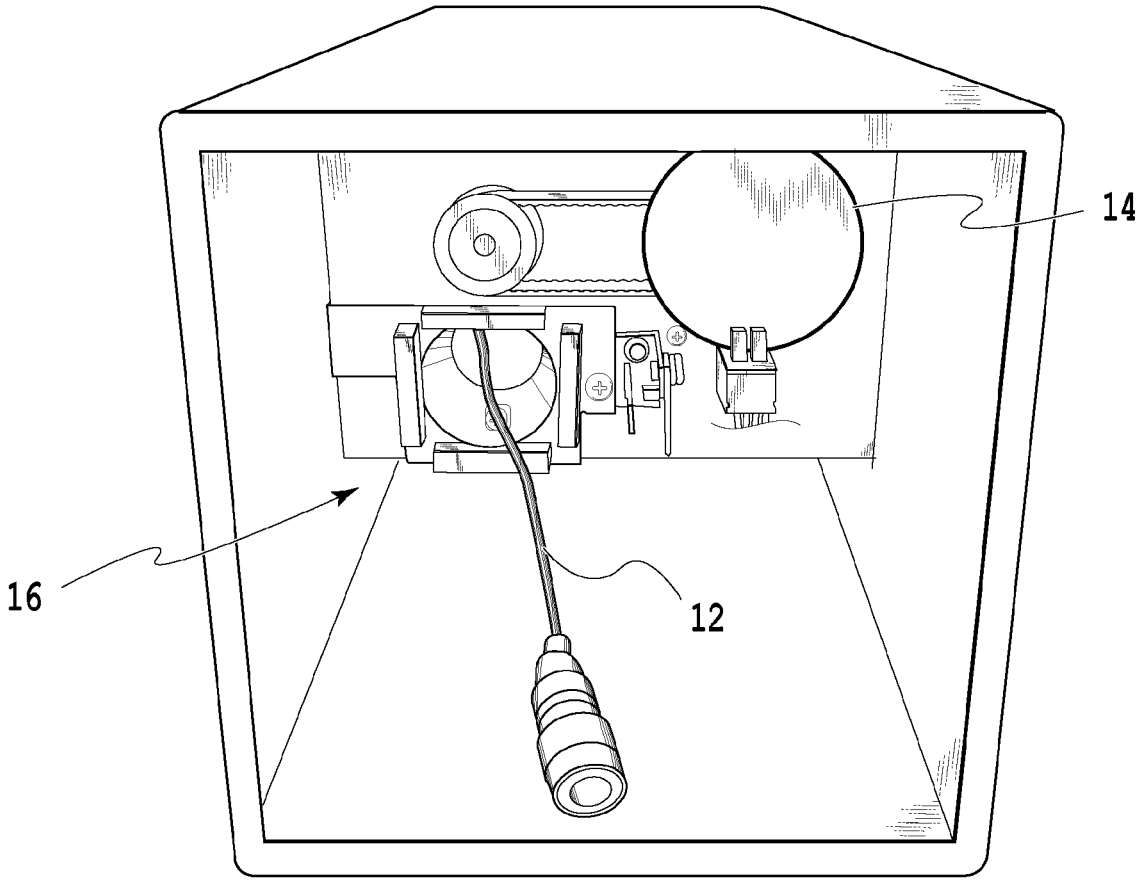
FIG. 5C illustrates the configuration of the detection unit and the anti-misdetection member according to the first embodiment.

The anti-misdetection member 15 is attached to the lower part of the detection unit 14 and functions to avoid the misdetection by the detection unit 14. With reference to FIG. 5A to FIG. 5C, the following section will describe the configurations of the detection unit 14 and the anti-misdetection member 15. The cord wheel included in the detection unit 14 is provided so that a face having the slits faces the lower face of the elevation apparatus 1. FIG. 5A illustrates the detection unit 14 when viewed from the lower part of the elevation apparatus 1. The lighting element 3 is suspended from the lower part of the elevation apparatus 1. This may cause an undesirable situation where light from the lighting element 3 passes through the slits of the cord wheel, resulting in the misdetection of the light by the detection unit 14, irrespective of the elevation of lighting element 3.

In order to avoid such an misdetection, as shown in FIG. 5B, the anti-misdetection member 15 has a face having a larger area than the slit face of the cord wheel and this face is provided at the lower part to be parallel with the slit face of the cord wheel. The structure as described above allows, as shown in FIG. 5C, the anti-misdetection member 15 provided in front of the detection unit 14 when viewed from the lower part of the elevation apparatus 1 to cover the cord wheel of the detection unit 14 (i.e., the cord wheel of the detection unit 14 cannot be visible from the lower part of the elevation apparatus 1). Thus, light of the lighting element 3 can be prevented from reaching the detection unit 14.

The reset switch 16 initializes the counter provided in the controller 4. As shown in FIG. 2, the reset switch 16 is provided at the lower part of the reel 11 and is covered by the housing 10 in the state where the lower housing 10*b* is closed. The lighting element 3 is lifted and the lighting element 3 itself depresses the reset switch 16, thereby resetting the counter of the controller 4.

The attaching part 17 is a member that has a screw type or bolt and nut type structure to attach the elevation apparatus 1 to the suspension baton 2. The attaching part 17 is used to attach the elevation apparatus 1 to the suspension baton 2 and the elevation apparatus 1 is suspended downwardly from the suspension baton 2. The attaching hook 18 has a structure in which hook is interlocked with a wire and provides a function to prevent the elevation apparatus 1 from falling off from the suspension baton 2.

The reel 11 the electric motor 13, the detection unit 14, the anti-misdetection member 15, and the reset switch 16 described above are accommodated in the housing 10 and are prevented, when the lower housing 10*b* is closed, from being exposed to the exterior. As described above, in order to achieve a representation with a higher visual effect, the above-described components are prevented from being visible by viewers.

In a stage representation, many elevation apparatuses 1 may be used in order that many lighting elements 3 use the respective elevation apparatuses 1 for implementing an elevating operation to provide a representation with a higher visual effect. Due to the situation as described above, in order to save the space required to transport many elevation apparatuses 1, the elevation apparatus 1 including the housing 10 having a rectangular parallelepiped shape is often placed on a floor while having the longitudinal direction set in the vertical direction. If the above-described components at the lower face of the housing 10 (i.e., the components are provided so that the components are exposed from the lower face even when the lower housing 10*b* is closed) for example, the weight of the elevation apparatus 1 may cause a load upon the exposed components, which may cause the breakage of the exposed components. To prevent this, the elevation apparatus 1 according to this embodiment allows the lower housing 10*b* when closed to accommodate the above-described components in the housing 10, thus protecting the components.

Based on a pulse signal outputted from the detection unit 14, the controller 4 calculates the travel distance of the lighting element 3. However, the travel distance of the lighting element 3 calculated by the controller 4 should be initialized due to noise detected by the light receiving element of the detection unit 14 for example. The following section will describe a configuration to initialize the travel distance.

Figure 6A:
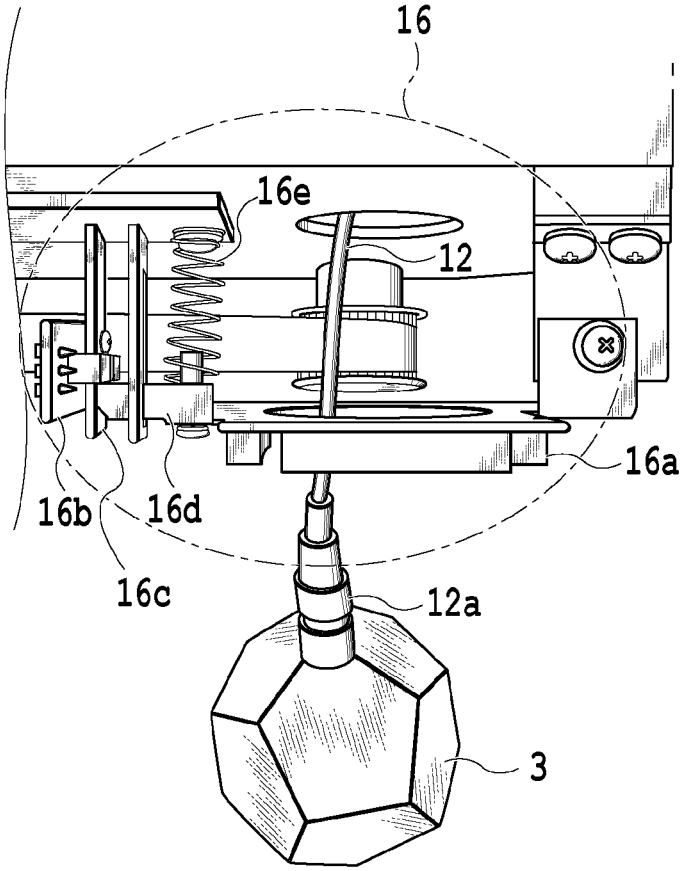
FIG. 6A illustrates the configuration of a reset switch according to the first embodiment.

Next, with reference to FIG. 6A and FIG. 68, the following section will describe the details of the reset switch 16. The reset switch 16 according to this embodiment includes an operation switch that opens or closes the contact point by the stress caused by lifting the lighting element 3 and moving an entering unit. As shown in FIG. 6A, the reset switch 16 includes an entering unit 16*a*, a connection terminal 16*b*, a fixed contact point 16*c*, a movable contact point 16*d*, and an elastic body 16*e*.

Figure 6B:
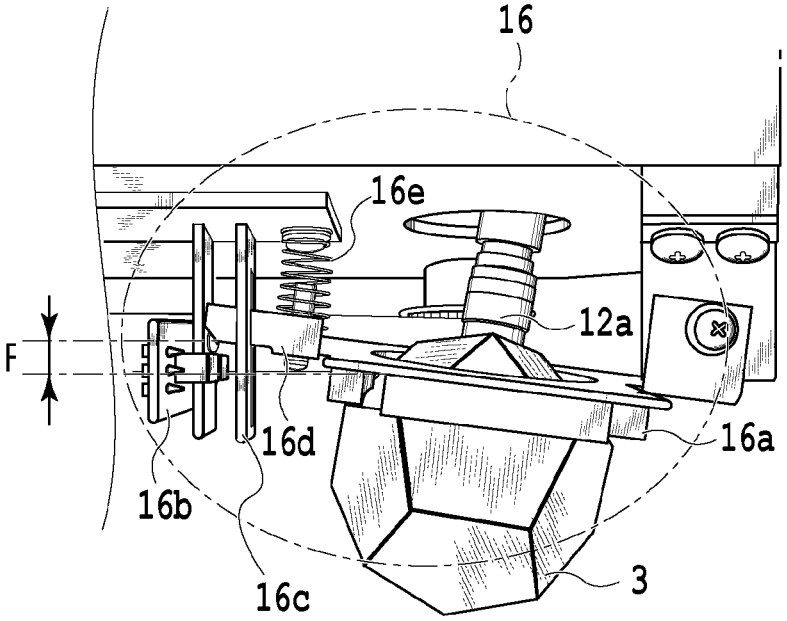
FIG. 6B illustrates the configuration of the reset switch according to the first embodiment.

The entering unit 16*a* is connected to the movable contact point 16*d* and functions to move the movable contact point 16*d* away from the fixed contact point 16*c* by the stress caused when the lighting element 3 lifts to have a contact with the entering unit 16*a*. The entering unit 16*a* has a fitting hole provided to face the lighting element 3 lifted from the lower side. As shown in FIG. 6B, when the lighting element 3 lifts, the lighting element 3 is fitted into the fitting hole. The lighting element 3 fitted into the fitting hole allows the stress of the lighting element 3 to lift entire the entering unit 16*a*, thereby moving the movable contact point 16*d* away from the fixed contact point 16*c*.

When the reset switch 16 is in a normal state, the contact point between the fixed contact point 16*c* and the movable contact point 16*d* is closed, thus the connection terminal 16*b* is conducted. When the movable contact point 16*d* is moved away from the fixed contact point 16*c*, the connection terminal 16*b* fails to be conductive. This state is detected by the controller 4. Depending on the detected state, an initialization instruction is issued to the above-described counter. Thereafter, the lighting element 3 is lowered due to the weight for example. Thus, the distortion caused in the elastic body 16*e* is removed and the movable contact point 16*d* is returned and has a contact with the fixed contact point 16*c*.

When the initialization instruction is issued, the counter of the controller 4 initializes the travel distance of the lighting element 3 calculated previously by adding the predetermined number at the falling timing of the pulse signal. A position at which the lighting element 3 is fitted into the entering unit 16*a* (fitting hole) of the reset switch 16 is a position at which the lighting element 3 is maximally rifled, that is, it corresponds to the initial position of the lighting element 3. As described above, the lighting element 3 itself depresses the reset switch 16 at a timing at which the lighting element 3 reaches the initial position. Thus, the calculated travel distance can be accurately initialized.

Based on this initialization, the controller 4 determines that the lighting element 3 has reached the initial position and provides a control by which the electric motor 13 is deactivated (e.g., a motor drive signal outputted to the electric motor 13 is turned to "Low"). Then, the elevating operation of the lighting element 3 is stopped. Thereafter, depending on the stage representation procedure, the controller 4 controls the lighting element 3 to be lowered. In response, the lighting element 3 is lowered. Depending on the the lighting element lowering, the detection unit 14 outputs a pulse signal and the controller 4 calculates the travel distance.

As described above, the elevation apparatus 1 according to the first embodiment has been described. The elevation apparatus 1 according to this embodiment has a configuration in which, even when an error is caused between the travel distance calculated by the lighting element 3 and an actual travel distance, the lighting element 3 itself depresses the reset switch 16 to initialize the calculated travel distance. This consequently initializes the travel distance at an accurate timing ant at a fixed timing. This can prevent a situation where accumulated errors prevent a desired elevating control from being realized.

Furthermore, the detection unit 14 and the reset switch 16 for example are accommodated in the housing 10. Thus, these components can be protected even when the elevation apparatus 1 having the longitudinal direction set in the vertical direction is placed on a floor. Furthermore, the closure of the lower housing 10*b* prevents the above-described component from being visible by viewers, thus preventing a deteriorated appearance in a stage representation. In addition, the lighting element 3 entered into the housing 10 allows, even when the reset switch 16 is provided in the housing 10, the lighting element 3 itself to depress the reset switch 16.

Second Embodiment

Next, the following section will describe the elevation apparatus 1 according to the second embodiment. The elevation apparatus 1 and the controller 4 for example according to the second embodiment have components similar to those described in the first embodiment. Thus, only different components will be described. In the first embodiment, the embodiment is described in which the lighting element 3 is suspended and the lighting element 3 has a face having a smaller area than the area of the lower face of the housing 10 of the elevation apparatus 1. However, according to the elevation apparatus 1 according to the second embodiment, an illumination apparatus 5 having a bar-like shape is suspended as a to-be-lifted object.

Figure 7:
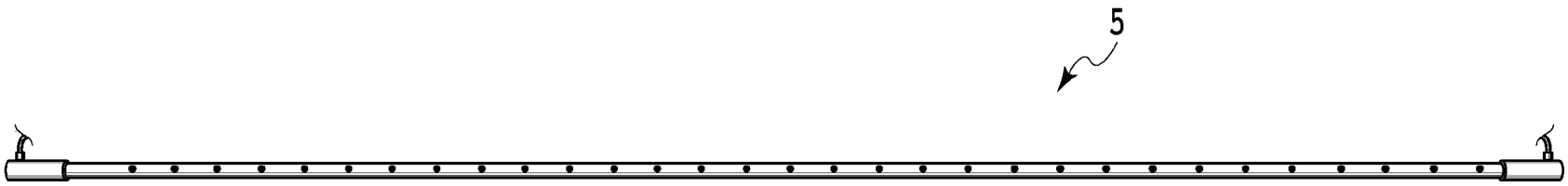
FIG. 7 illustrates the configuration of an illumination apparatus according to the second embodiment.

As shown in FIG. 7, the illumination apparatus 5 has a bar-like shape and includes therein a plurality of the lighting elements 3. The respective plurality of the lighting elements 3 have the light intensity changing over time depending on a control signal from the controller 4. By elevating this illumination apparatus 5, the representation effect similar to that described in the first embodiment can be realized. The configuration as described above can allow more lighting elements 3 to be controlled by elevation apparatuses 1 fewer than those in the case in which the single lighting element 3 is used.

Figure 8:
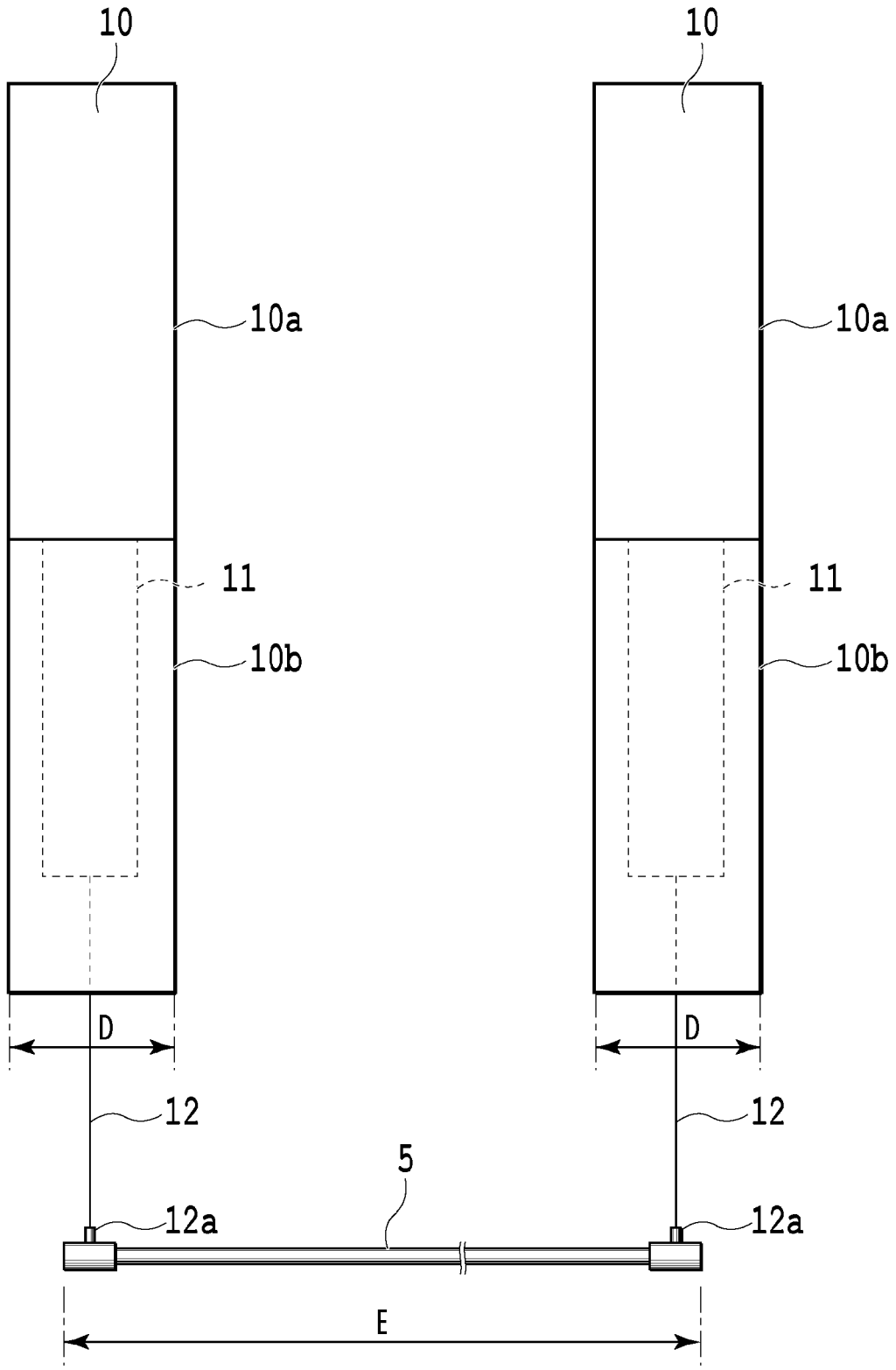
FIG. 8 illustrates the relation between a housing and the illumination apparatus according to the second embodiment.

As shown in FIG. 8, the illumination apparatus 5 has both ends attached to the tip ends of the reel wires 12 via the connector 12*a* respectively. The illumination apparatus 5 is suspended so as to have the longitudinal direction set in the lateral direction at the lower side of the elevation apparatus 1. In a face of the illumination apparatus 5 in the longitudinal direction, the length E in the longitudinal direction is longer than the length D of the opening of the housing 10 opposed thereto. Specifically, the length of the face of the illumination apparatus 5 in the longitudinal direction is longer than the length of any side of the opening of the housing 10. This means that, in contrast with the lighting element 3 described in the first embodiment, the illumination apparatus 5 is prevented, when being rifted, from entering the inside of the housing 10 of the elevation apparatus 1, thus preventing the illumination apparatus 5 from depressing the reset switch 16. In order to allow the illumination apparatus 5 having such a structure to depress the reset switch 16, the elevation apparatus 1 according to the second embodiment has the reset switch 16 having a structure different from that described in the first embodiment.

Figure 9A:
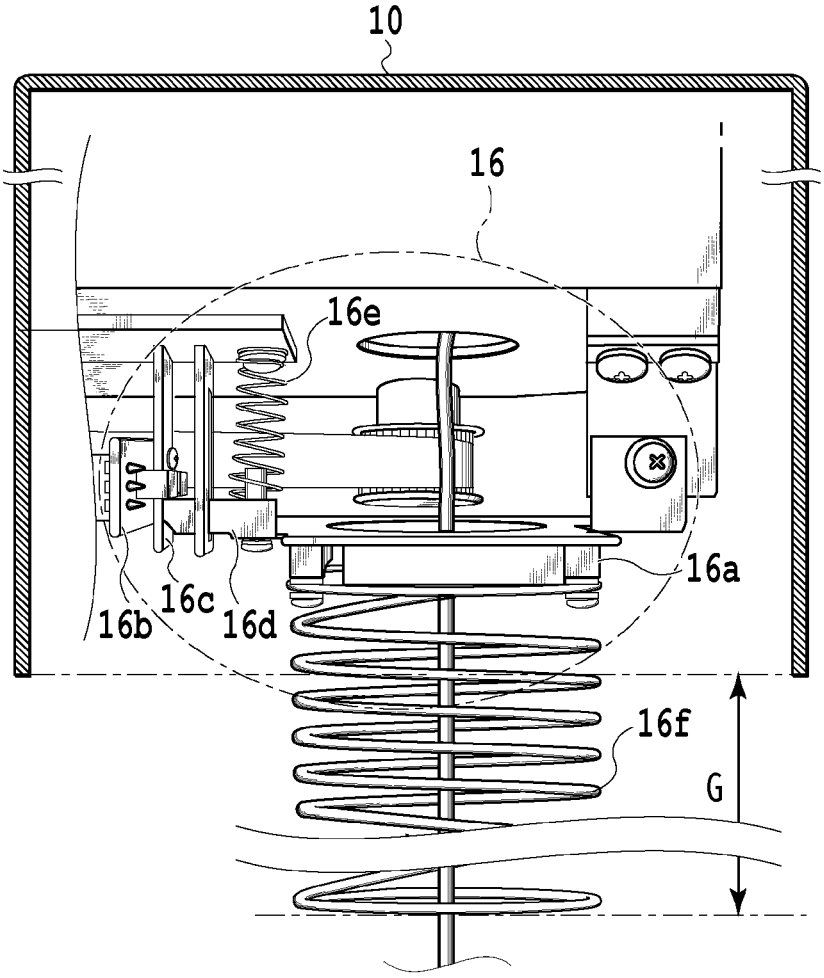
FIG. 9A illustrates the configuration of the reset switch according to the second embodiment.
Figure 9B:
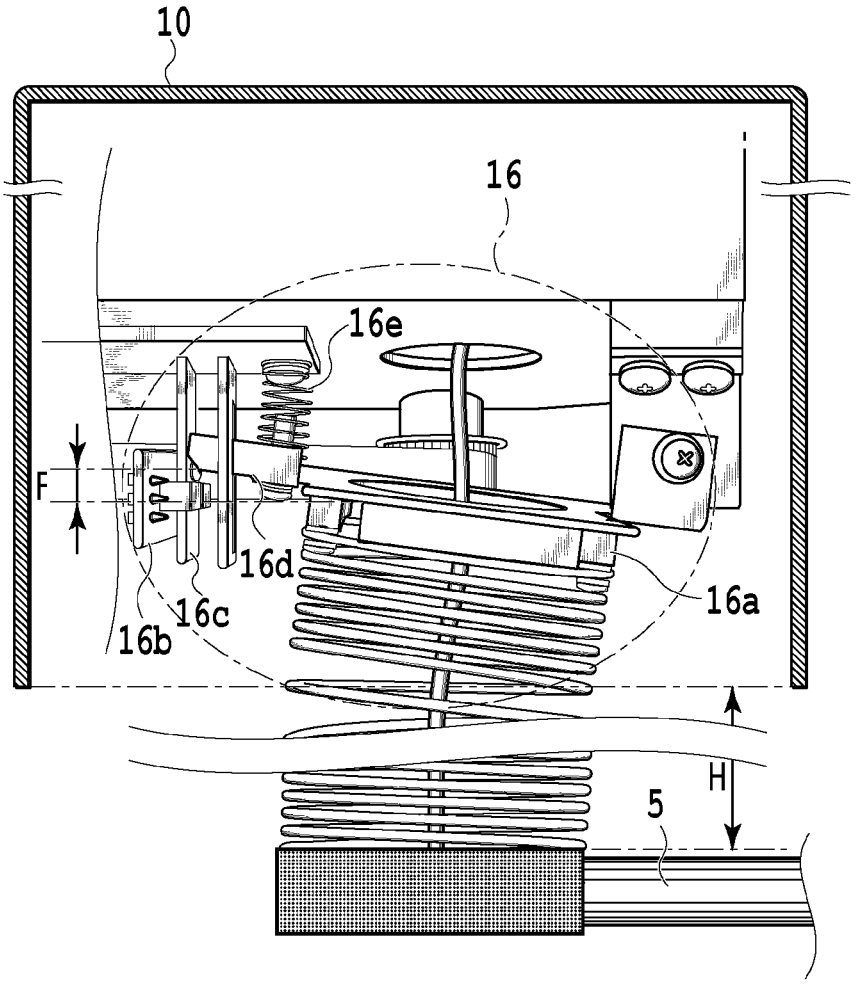
FIG. 9B illustrates the configuration of the reset switch according to the second embodiment.

With reference to FIG. 9A and FIG. 9B, the following section will describe the reset switch 16 according to the second embodiment. The reset switch 16 according to the second embodiment includes an elastic body 16*f* in addition to the components provided in the reset switch 14 described in the first embodiment. As shown in FIG. 9A, the elastic body 16*f* has an upper end connected to the lower part of the entering unit 16*a* and is provided so as to transmit the stress from the lower end to the entering unit 16*a*. In this embodiment, the elastic body 16*f* includes a spring, but also may include any elastic body such as rubber.

The elastic body 16*f* is connected to the lower part of the entering unit 16*a* in the housing 10. The lower part of the elastic body 16*f* is protruded through the opening of the housing 10. As shown in FIG. 9B, the portion protruded through the opening of the housing 10 of the elastic body 16*f* (protruded portion) has the length G in the vertical direction that is longer than a movable width F when the movable contact point 16*d* is lifted upwardly. This configuration allows the protruded portion to contact with the entering unit 16*a*, even when the illumination apparatus 5 cannot enter the inside of the housing 10. When the illumination apparatus 5 lifts and contacts with the protruded portion, distortion is generated in the elastic body 16*f* to apply stress to the entering unit 16*a*. This stress causes the entering unit 16*a* to be entirely lifted to move the movable contact point 16*d* away from the fixed contact point 16*c*, thereby issuing an initialization instruction to the above-described counter.

When the movable contact point 16*d* is away from the fixed contact point 16*c*, the illumination apparatus 5 has a position at which the illumination apparatus 5 is maximally lifted. Specifically, this position is the initial position of the illumination apparatus 5. As described above, the illumination apparatus 5 itself depresses the reset switch 16 at a timing at which the illumination apparatus 5 has reached the initial position. Thus, the calculated travel distance can be initialized accurately.

This initialization allows for determining that the illumination apparatus 5 has reached the initial position and controlling to deactivate the electric motor 13 (e.g., a motor drive signal outputted to the electric motor 13 is turned to "Low"), thereby stopping the elevating operation of the illumination apparatus 5. Thereafter, the illumination apparatus 5 is lowered due to the weight for example to remove the distortion caused in the elastic body 16*f* and the movable contact point 16*d* is returned to have a contact with the fixed contact point 16*c* again.

The protruded portion has the length G longer than that of the above-described width F. Thus, regardless of the elastic modulus of the elastic body 16*f*, the illumination apparatus 5 can be prevented from having a contact with the lower end of the side wall of the housing 10. Specifically, the following formula (1) is established.

$$\text{Protruded portion length } G - \text{width } F = \text{Interval } H \qquad \text{Formula (1)}$$

As can be seen from Formula (1), the protruded portion length G is longer than the width F and a difference therebetween is H. When the movable contact point 16*d* is raised by the width F, the initialization instruction is issued at which the illumination apparatus 5 does not lift any more. Thus, as shown in FIG. 9B, the interval H is secured between the upper face of the illumination apparatus 5 and the lower face of the housing 10.

In a stage representation, the elevation apparatus 1 desirably has less light weight structure as described above. The illumination apparatus 5, which is a to-be-lifted object, also desirably has less light-weight structure. Thus, in order to have a light-weight structure, the illumination apparatus 5 is formed to have a thin bar-like shape including acrylic resin for example. This structure is disadvantageous in being weak against the shock. In this embodiment, the interval H is secured during the lift of the illumination apparatus 5 while preventing the illumination apparatus 5 from having a contact with the housing 10 of the elevation apparatus 1. This prevents the contact between the illumination apparatus 5 and the housing 10 when the reset switch 16 is depressed (i.e., the shock on the illumination apparatus 5). On the other hand, even when the contact with the elastic body 16*f* is caused, the distortion of the elastic body 16*f* prevents the shock on the illumination apparatus 5.

As described above, the elevation apparatus 1 according to the second embodiment has been described. The elevation apparatus 1 according to this embodiment is similarly configured so that the illumination apparatus 5 itself can depress the reset switch 16 to initialize the calculated travel distance at an accurate timing. Furthermore, the use of the elastic body 16*f* can depress the reset switch 16, even when the illumination apparatus 5 cannot enter the inside of the housing 10.

Even when the elastic body 16*f* is protruded from the lower face of the housing 10, the distortion caused by applying the stress can prevent the elastic body 16*f* from being broken, even when the elevation apparatus 1 having the longitudinal direction set in the vertical direction is placed on a floor for example. The protruded portion can be visible for viewers of a stage representation. Thus, in order to minimize the size of the protruded portion, the length of the elastic body 16*f* in the vertical direction is desirably minimized while maintaining the relation shown in the above-described Formula (1).

Third Embodiment

Next, the following section will describe the elevation apparatus 1 according to the third embodiment. The elevation apparatus 1 and the controller 4 according to the third embodiment for example have components similar to those described in the first and second embodiments. Thus, only different components will be described. The illumination apparatus 5 described in the second embodiment is similarly suspended in the third embodiment.

The elevation apparatus 1 described in the second embodiment has a structure in which the elastic body 16*f* is protruded from the lower face of the housing 10. However, in a stage representation, the elevation apparatus 1 is visible by viewers and thus the above-described protruded portion can be also visible for viewers, thus disadvantageously causing a deteriorated appearance. The elevation apparatus 1 according to the third embodiment has a structure that can prevent a deteriorated appearance while allowing the illumination apparatus 5 to depress the reset switch 16.

Figure 10A:
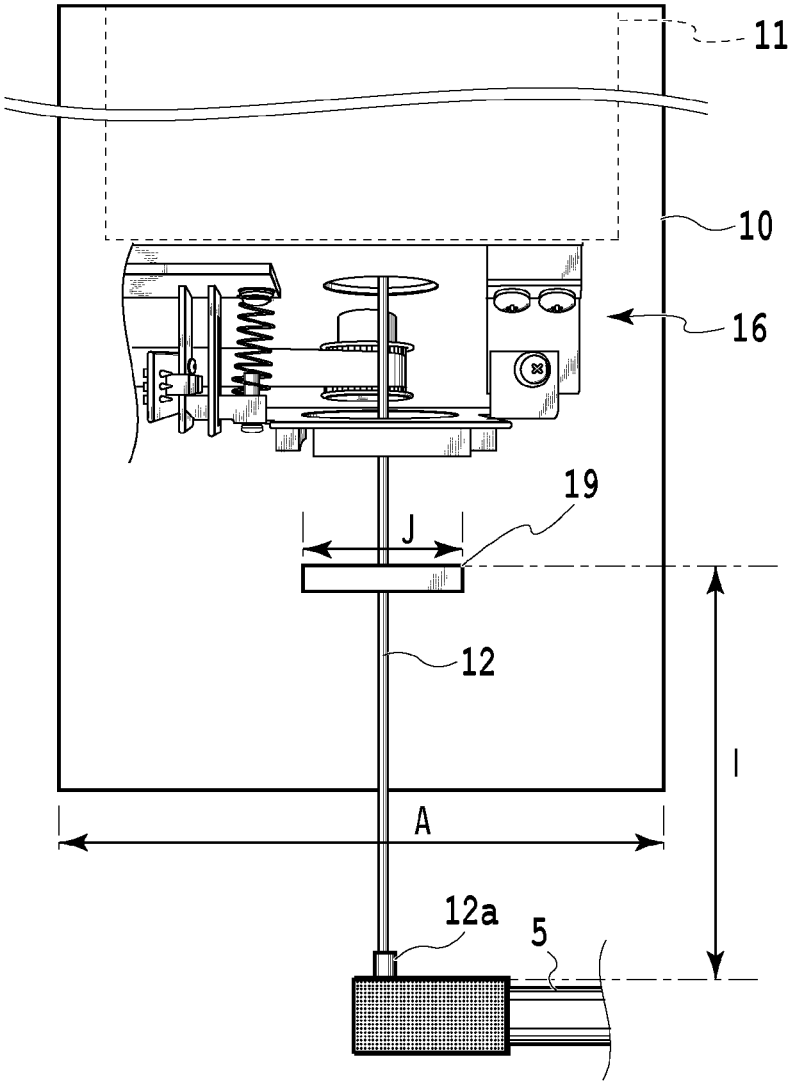
FIG. 10A illustrates the relation among the housing, the illumination apparatus, and an entering member according to the second embodiment.
Figure 10B:
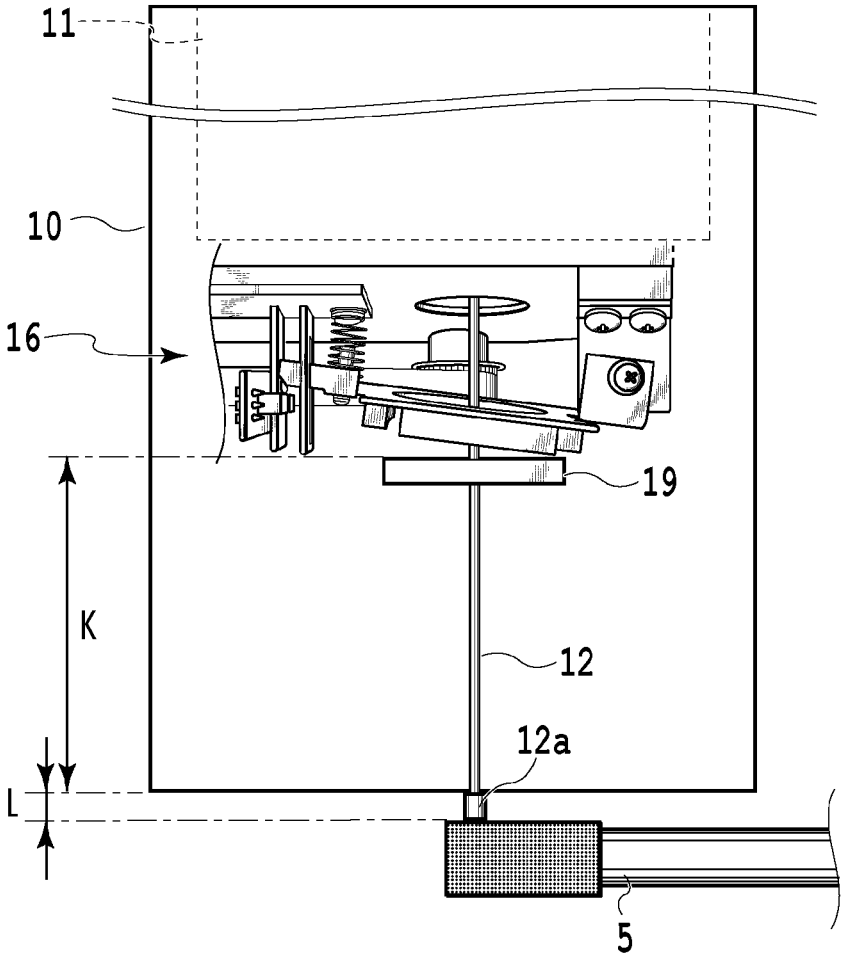
FIG. 10B illustrates the relation among the housing, the illumination apparatus, and the entering member according to the second embodiment.

With reference to FIG. 10A and FIG. 10B, a structure of the elevation apparatus 1 according to the third embodiment is shown. As shown in FIG. 10A, the elevation apparatus 1 further includes an entering member 19 in addition to the components provided in the elevation apparatus 1 described in the first embodiment. The entering member 19 is a member having a thin plate-like shape and has an arbitrary cross section. The entering member 19 has a cross section having an area J that is smaller than the area A of the opening of the housing 10. The entering member 19 has a penetration hole at the center of the cross section thereof. The reel wire 12 passes through the penetration hole. The cross section is fixed to the reel wire 12 so as to face the downward cross section of the entering unit 16*a* of the reset switch 16. A position at which the entering member 19 is fixed to the reel wire 12 is provided between the illumination apparatus 5 and the reset switch 16. This structure allows the entering member 19 to enter the inside of the housing 10 when the illumination apparatus 5 is lifted.

In this embodiment, the entering member 19 has a thin plate-like shape. However, the embodiment is not limited to such a shape. The entering member 19 may have a face having an area smaller than the area A of the opening of the housing 10. The entering member 19 may have an arbitrary shape to enter the inside of the housing 10 through the opening of the housing 10. In consideration of the visibility of viewers, the entering member 19 preferably has a smaller shape under the above-described conditions.

When the entering member 19 lifted together with the illumination apparatus 5 has a contact with the entering unit 16*a* the stress caused by the entering member 19 allows the entering unit 16*a* to be entirely lifted to move the movable contact point 16*d* away from the fixed contact point 16*c*. The position of the entering member 19 at this time is called the highest reaching point. When the movable contact point 16*d* is moved away from the fixed contact point 16*c*, the connection terminal 16*b* fails to be conductive. This failure is detected by the controller 4 depending on which the initialization instruction is issued to the above-described counter.

The position of the illumination apparatus 5 when the entering member 19 is lifted to the highest reaching point is a position at which the illumination apparatus 5 is maximally lifted (i.e., the initial position of the illumination apparatus 5 is reached). As described above, the illumination apparatus 5 itself depresses the reset switch 16 at a timing at which the illumination apparatus 5 reaches the initial position. Thus, the calculated travel distance can be accurately initialized. Thereafter, the illumination apparatus 5 is lowered due to the weight for example to remove the distortion caused in the elastic body 16*e* and the movable contact point 16*d* is returned to have a contact with the fixed contact point 16*c* again. The operation of the counter after the initialization instruction is issued is as described in Embodiments 1 and 2.

The distance I between the upper face of the entering member 19 and the upper face of the illumination apparatus 5 in the longitudinal direction is shorter than the distance K between the lower face of the housing 10 and the upper face of the entering member 19 at a position at which the entering member 19 is lifted to the highest reaching point. Specifically, the following formula (2) is established.

$$\text{Distance } I - \text{distance } K = \text{interval } L \qquad \text{Formula (2)}$$

As can be seen from the formula (2), the distance I is longer than the distance K and the difference therebetween is "L". The initialization instruction is issued when the entering member 19 is lifted to the highest reaching point and the entering member 19 is not lifted any more. Thus, as shown in FIG. 10B, the interval L is secured between the upper face of the illumination apparatus 5 and the lower face of the housing 10. As described above, in this embodiment, the illumination apparatus 5 is configured not to have a contact with the housing 10 of the elevation apparatus 1. This consequently prevent the illumination apparatus 5 from having a contact with the housing 10 in order to depress the reset switch 16 (i.e., the impact to the illumination apparatus 5).

As described above, the elevation apparatus 1 according to the third embodiment has been described above. The elevation apparatus 1 according to this embodiment also allows the illumination apparatus 5 itself to depress the reset switch 16 to initialize the calculated travel distance at an accurate timing. Furthermore, the entering member 19 allows, even when the illumination apparatus 5 cannot enter the inside of the housing 10, the illumination apparatus 5 to depress the reset switch 16 and the components therein are covered by the housing 10, thus preventing a deteriorated appearance.

In the above-described first to third embodiments, an example embodiment is shown in which the connector 12*a* of the reel wire 12 is attached to the lighting element 3 or the illumination apparatus 5. However, the embodiment is not limited to such an example. For example, the lighting element 3 or the illumination apparatus 5 may be substituted with a to-be-lifted object having any shape and size such as a mirror. The elevation apparatus 1 according to the first embodiment is applied when the to-be-lifted object has a cross section having an area smaller than the area of the opening of the housing 10 (i.e., when the to-be-lifted object can enter the inside of the housing 10 through the opening of the housing 10 during the lift). On the other hand, the elevation apparatus 1 according to the second embodiment or the third embodiment is applied when the to-be-lifted object has a cross section having a larger area than the area of the opening of the housing 10 (i.e., when the to-be-lifted object cannot enter the inside of the housing 10 through the opening of the housing 10 during the lift).

In any of the first embodiment to the third embodiment, the elevation apparatus 1 and the controller 4 are provided as a separate device. However, the function of the controller 4 may be integrated with the elevation apparatus 1. Specifically, any of the specification and the attached claims, the elevation apparatus 1 includes the controller 4 and an element to issue an initialization instruction to a counter is called a controller.

REFERENCE SIGNS LIST

1 Elevation apparatus
2 Suspension baton
3 Lighting element

4 Controller
5 Illumination apparatus
10 Housing
10*a* Upper housing
10*b* Lower housing
11 Reel
12 Reel wire
12*a* Connector
13 Electric motor
14 Detection unit
15 Anti-misdetection member
16 Reset switch
16*a* Entering unit
16*b* Connection terminal
16*c* Fixed contact point
16*d* Movable contact point
16*e* Elastic body
16*f* Elastic body
17 Attaching part
18 Attaching hook
19 Entering member

The invention claimed is:

1. An elevation apparatus provided in a longitudinal direction set in a vertical direction, comprising:

a housing that has a side wall in a longitudinal direction and that has an opening in a lower face;

a reel rotating to wind a reel wire, wherein the reel wire is wound on the reel to elevate a to-be-lifted object attached to a tip end of the reel wire, and the to-be-lifted object is suspended from the lower side of the elevation apparatus;

a controller for calculating a travel distance along which the to-be-lifted object is elevated; and a reset switch provided in the housing, wherein the to-be-lifted object is lifted to depress the reset switch and the depression of the reset switch allows the controller to initialize the calculated travel distance.

2. The elevation apparatus according to claim 1, wherein:

the to-be-lifted object has a face having an area smaller than the area of the opening, the to-be-lifted object is lifted to enter the housing through the opening to depress the reset switch, and the reset switch is provided at a position at which the to-be-lifted object is maximally lifted.

3. The elevation apparatus according to claim 1, wherein:

the to-be-lifted object includes a light emitting element, the elevation apparatus further includes:

a rotary encoder that is provided in the housing and that detects the rotation amount of the reel; and an anti-misdetection member provided between the rotary encoder and the to-be-lifted object.

4. The elevation apparatus according to claim 1, wherein:

the to-be-lifted object has face having an area larger than the area of the opening or a face having a length longer than the length of any side of the opening, the reset switch has an elastic body attached to the lower side, a portion of the elastic body is protruded from the lower part of the housing, and the to-be-lifted object is lifted to have a contact with the elastic body to depress the reset switch.

5. The elevation apparatus according to claim 1, wherein:

the to-be-lifted object has face having an area larger than the area of the opening or a face having a length longer than the length of any side of the opening, the elevation apparatus further includes an entering member that is attached to the reel wire, that is lifted by winding the reel wire on the reel, and that is positioned at an upper side of the to-be-lifted object, the entering member has a face having an area smaller than the area of the opening; and the entering member is lifted to enter the housing through the opening to depress the reset switch.

6. The elevation apparatus according to claim 5, wherein:

a distance between an upper face of the entering member and a lower face of the housing when the entering member depresses the reset switch is shorter than a distance between the upper face of the entering member and an upper face of the to-be-lifted object.

* * * * *